US010124865B2

(12) United States Patent
Bridges

(10) Patent No.: US 10,124,865 B2
(45) Date of Patent: Nov. 13, 2018

(54) FORWARD FACING STANDUP ROWING WATERCRAFT

(71) Applicant: Robert J. Bridges, Pacific Palisades, CA (US)

(72) Inventor: Robert J. Bridges, Pacific Palisades, CA (US)

( * ) Notice: Subject to any disclaimer, the term of this patent is extended or adjusted under 35 U.S.C. 154(b) by 0 days.

(21) Appl. No.: 15/487,200

(22) Filed: Apr. 13, 2017

(65) Prior Publication Data

US 2018/0297671 A1 Oct. 18, 2018

(51) Int. Cl.

| | |
|---|---|
| ***B63B 35/79*** | (2006.01) |
| ***B63B 3/48*** | (2006.01) |
| ***B63B 35/71*** | (2006.01) |

(52) U.S. Cl.

CPC ..... *B63B 35/7906* (2013.01); *B63B 3/48* (2013.01); *B63B 35/71* (2013.01); *B63B 35/7936* (2013.01); *B63B 2035/715* (2013.01)

(58) Field of Classification Search

CPC ... B63B 3/48; B63B 35/7906; B63B 35/7936; B63B 35/71

See application file for complete search history.

(56) References Cited

U.S. PATENT DOCUMENTS

| | | | | |
|---|---|---|---|---|
| 4,052,951 | A | 10/1977 | Farr | |
| 4,623,314 | A | 11/1986 | Waugh | |
| 4,776,821 | A | 10/1988 | DuPont | |
| 4,889,509 | A | 12/1989 | Pohlus | |
| 5,127,859 | A | 7/1992 | Rantilla | |
| 5,215,482 | A | 6/1993 | Henry | |
| 5,647,782 | A * | 7/1997 | Henry | B63H 16/105 440/102 |
| 6,109,988 | A * | 8/2000 | Dunn, Jr. | B63H 16/06 440/104 |
| 6,113,447 | A | 9/2000 | Roy et al. | |
| 6,817,913 | B1 | 11/2004 | Witham | |
| 7,070,470 | B2 | 7/2006 | Bleicken | |
| 9,376,176 | B1 | 6/2016 | Holden | |
| 9,428,253 | B1 | 8/2016 | Morgan et al. | |
| 2008/0302293 | A1 | 12/2008 | Nesseth | |
| 2014/0245943 | A1 * | 9/2014 | Swan | B63B 7/087 114/345 |
| 2016/0280338 | A1 | 9/2016 | Parkinson et al. | |

* cited by examiner

*Primary Examiner* — Stephen P Avila
(74) *Attorney, Agent, or Firm* — Anthony D. Seach

(57) ABSTRACT

A standup forward facing rowing watercraft is disclosed. The craft includes a hull having first and second opposed ends; a deck affixed to the hull, the deck including a surface for supporting a rider who may face in the direction of the movement of the watercraft; and an outrigger attached to the deck, the outrigger including a pivot point that extends outwardly from the deck, the pivot point being capable of accepting an oar. The oar is capable of rotating in the pivot point so as to allow a rider to employ a j-stroke to provide forward course correction when powering the watercraft with one oar. The outrigger can be adapted to include a second pivot point extending outwardly from the deck, the second pivot point being capable of accepting a second oar. The outrigger may preferably be adapted for longitudinal movement in relation to the deck of the watercraft.

16 Claims, 7 Drawing Sheets

FORWARD FACING STANDUP ROWING WATERCRAFT

FIELD

The disclosure relates to watercraft rowed by a person in the standing position while facing the direction of travel.

BACKGROUND

Standup paddle boarding is a popular recreational sport involving a rider standing atop a floating craft and using an unmounted oar to paddle the craft. Traditional paddle boarding utilizes one oar, which is not affixed to the craft, and the rider's body, as the sole source of propulsion. Propulsion is provided by replicating a paddling stroke similar to that of a canoer. Generating propulsion with a paddle when the paddle is not mounted to the craft is inefficient as no mechanical leverage is utilized. Additionally, propulsion provided by a single paddle requires a rider to alternate strokes on either side of the craft to maintain a straight course. Traditional sculling boats utilize a fixed fulcrum and sliding seat to provide more efficient propulsion. In traditional sculling, however, one must face rearwards and utilize a sliding seat mechanism. The sliding seat mechanism of a sculling or rowing boat provides mechanical leverage, but is not practical for use in a standing position. Accordingly, there has been a long-felt need for improved efficiency and performance of watercraft, and in particular for a craft powered by forward-facing rowing in a standing position and including a fixed fulcrum and slide to provide mechanical leverage.

SUMMARY

One aspect of the disclosed watercraft features a hull having first and second opposed ends; a deck affixed to the hull, the deck including a surface for supporting a rider; and an outrigger attached to the deck, the outrigger including a pivot point that extends outwardly from the deck, the pivot point being capable of accepting an oar. In one such embodiment, the oar is capable of rotating in the pivot point so as to allow a rider to employ a "j-stroke" to provide forward course correction when powering the watercraft with one oar. As will be evident to one of ordinary skill in the art having the benefit of this summary, the outrigger can be adapted to include a second pivot point extending outwardly from the deck, the second pivot point being capable of accepting a second oar.

In one embodiment, the watercraft includes a footboard attached to the deck for receiving the foot of a rider. The footboard may be any surface that allows a rider to apply force thereto with the rider's foot. In some embodiments, the footboard may also include a foot strap to restrain a rider's foot to the footboard.

In another embodiment, the outrigger, including pivot points, is adapted to be removable from the deck of the watercraft. In such an embodiment, the outrigger is removably attached to the deck of the watercraft by any suitable means, including screws, clips, or a recess formed in the deck of the watercraft.

In various embodiments, the watercraft includes a slide assembly affixed to the deck of the watercraft. The slide assembly includes a first rail and a second rail mounted longitudinally to the deck of the watercraft and configured to allow longitudinal movement between the first rail and second rail. In such embodiments, the outrigger with pivot point, and footboard are attached to the second rail of the slide assembly. It will be evident to one of ordinary skill in the art having the benefit of this summary that the outrigger may include a second pivot point capable of accepting an oar. In one preferred embodiment, the slide assembly includes a set of first rails and a set of second rails.

In one embodiment, the watercraft includes a brake mechanism attached to the second rail of the slide assembly that interacts with the first rail of the slide assembly to prevent movement as between the first rail and the second rail. In some embodiments, the brake mechanism includes a contact surface connected to a boss, which may include a post or other support structure, which is inserted in a recess formed in the second rail of the slide assembly. In such an embodiment, a spring, which may surround the post, may interact with the post and the second rail to urge the brake mechanism in a disengaged position relative to the first rail. In another embodiment that also includes a spring, the spring interacts with the second rail and the contact surface to urge the brake mechanism in a disengaged position relative to the first rail. Upon application of pressure to the contact surface, the spring is compressed, and the post engages a brake receiving recess formed in the first rail of the slide assembly. The engagement of the post in the recess prevents relative movement between the first rail and the second rail of the slide assembly.

In alternative embodiments, the brake mechanism is capable of maintaining an engaged position relative to the brake receiving recess.

In other embodiments, the brake mechanism includes a contact surface, and may include a friction surface connected to the contact surface. That connection may include a boss inserted into a recess formed in the second rail. A spring attached to the friction surface urges the brake mechanism in a disengaged position relative to the first rail. Upon application of pressure to the contact surface, the spring is compressed, and the friction surface contacts the first rail of the slide assembly. The contact of the friction surface with the first rail of the slide assembly restricts movement between the first and second rails.

In another embodiment, the brake mechanism further includes a caliper retaining friction surfaces connected to the contact surface. Upon application of pressure to the contact surface, a caliper urges a friction surface into contact with the first rail.

In another embodiment, the invention includes a paddle board configured for a standing rower that includes a surface for supporting the rower, a slide assembly with a first rail and a second rail configured for longitudinal movement as between each other, an outrigger with at least one pivot point and a footboard with a restraining strap both attached to the second rail of the slide assembly. The first rail and second rail are configured to allow longitudinal movements as between the first rail and second rail. In a preferred embodiment, the slide assembly includes a set of first rails and a set of second rails.

In some embodiments, a first rail of the slide assembly includes a plurality of bearings retained in the first rail, and a second rail adapted to receive the first rail so as to allow longitudinal movement as between the first rail and the second rail. In still other embodiments, the bearings are retained in carriages attached to a second rail, and the carriages are adapted to receive a first rail of the slide assembly.

In yet another embodiment, the slide assembly, including the outrigger, pivot points, and footboard, are adapted to be removable from the deck and hull. In such an embodiment, the slide assembly, including the outrigger, pivot points, and footboard, are removably attached to the deck of the watercraft by any suitable means, including screws, clips, or a recess formed in the deck of the watercraft.

In some embodiments, the hull and deck may comprise a unitary assembly. Such unitary assemblies may include surfboards, sculling boats, paddleboards, skiffs, dories, and other composite watercraft.

DETAILED DESCRIPTION

Figure 1:
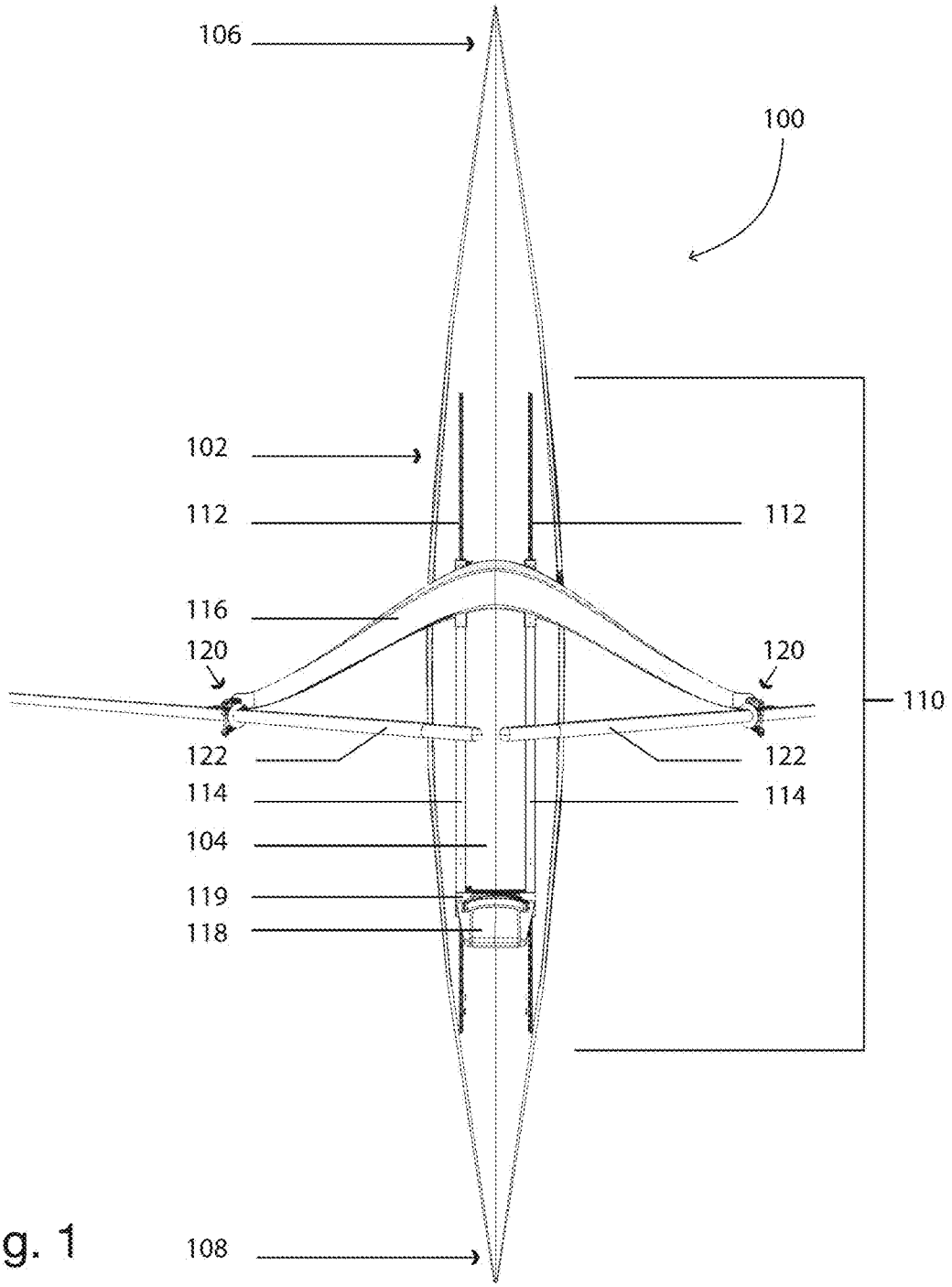
FIG. 1 shows a top view of one embodiment of the novel watercraft assembly.

The following detailed description of exemplary embodiments of the novel watercraft is for purposes of illustration and enablement only, but is not intended to limit the scope of the appended claims. Various changes may be made in the function and arrangement of the elements described in these embodiments without departing from the scope of the appended claims. The description herein may be adapted and employed with alternatively configured devices having different shapes, components, mechanisms, structures, materials and the like FIG. 1 depicts a top view of one embodiment of watercraft 100 including hull 102 and deck 104 affixed to hull 102. Hull 102 and deck 104 each have bow 106 and stern 108 ends. The embodiment depicted in FIG. 1 includes slide assembly 110 affixed to deck 104. Slide assembly 110 includes a set of first rails 112 affixed to hull 102 and configured to receive a set of second rails 114. First rail 112 and second rail 114 are joined so as to allow lateral movement as between first rail 112 and second rail 114. Restraining strap 119 is attached to footboard 118 to restrain a rider's foot. Outrigger 116 is attached to the bow-end of slide assembly 110 and footboard 118 is attached to the stern-end of slide assembly 110. Outrigger 116 includes two pivot points 120 that are adapted to accept one oar 122 each. In some embodiments, outrigger 116 includes only one pivot point 120 and oar 122. Pivot points 120 may be open or closed oarlocks, or another structure sufficient to support oars 122 when in use.

Figure 2:
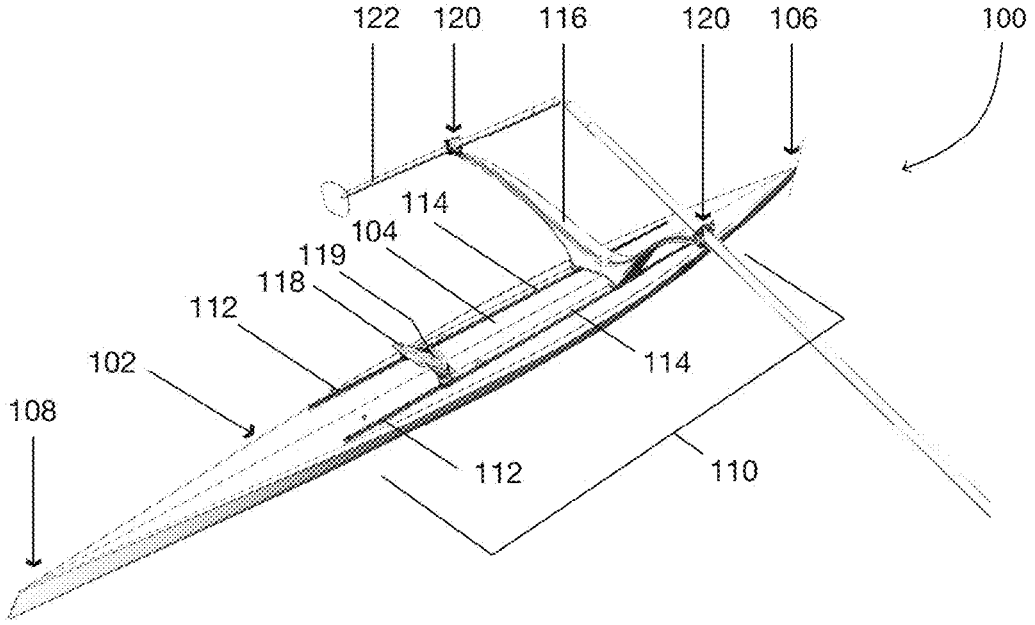
FIG. 2 shows an isometric view of one embodiment of the novel watercraft assembly.

FIG. 2 shows an isometric view of FIG. 1.

In an alternate embodiment of watercraft 100, outrigger 116 is attached directly to deck 104 with or without need for slide assembly 110. Without the slide assembly, outrigger 116 does not move relative to deck 104. Outrigger 116 may be attached to deck 104 with conventional fastening systems including, but not limited to, threaded and non-threaded fasteners, or adhesives. It is further contemplated that outrigger 116 may be attached to deck 104 with attachable or integral clips, or recess formed in deck 104 of watercraft 100.

In one embodiment, slide assembly 110 is substantially permanently attached to deck 104. Slide assembly 110 may be attached to deck 104 with conventional fastening systems including, but not limited to, threaded or non-threaded fasteners, or adhesives. In alternative embodiments, slide assembly 110 is removably attached to deck 104 to allow watercraft 100 to be used as a traditional paddle board. In such an embodiment, outrigger 116 is removably attached to deck 104 of watercraft 100 by, for example, screws, clips, a recess formed in deck 104 of watercraft 100, or by other suitable means.

Figure 3A:
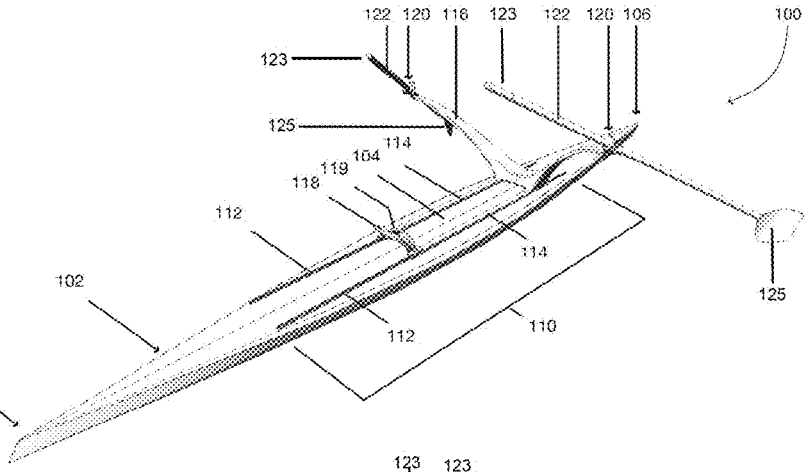
FIG. 3A shows an isometric view of one embodiment of the novel watercraft assembly with a slide assembly depicted in a forward position.
Figure 3B:
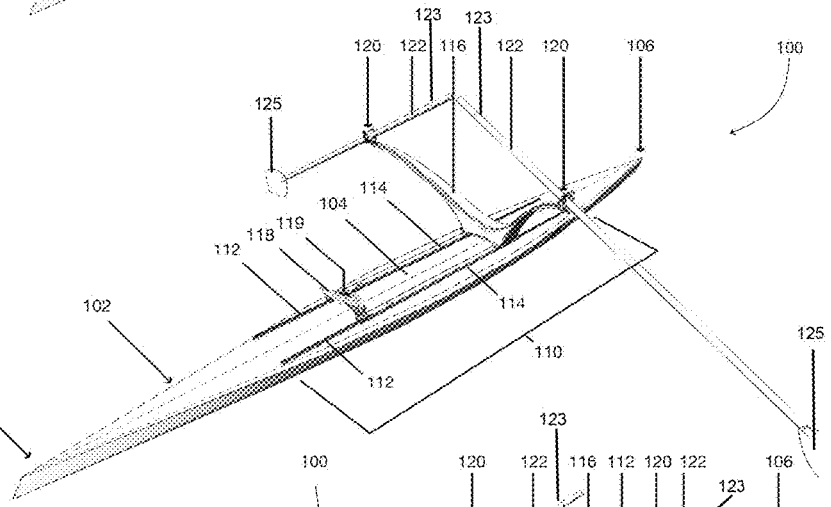
FIG. 3B shows an isometric view of one embodiment of the novel watercraft assembly with a slide assembly depicted in a neutral position.
Figure 3C:
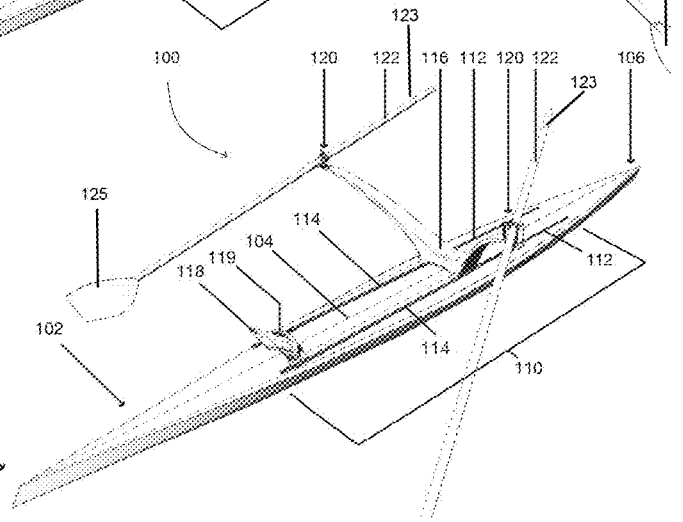
FIG. 3C shows an isometric view of one embodiment of the novel watercraft assembly with a slide assembly depicted in a rear position.

With reference to FIG. 3*a*, a rider using watercraft 100 places a foot on footboard 118. With one foot secured to footboard 118 by restraining strap 119, and the other foot on deck 104, a rider uses a foot to move footboard 118 forward, which moves set of second rails 114, outrigger 116, and pivot points 120 to a forward position. Simultaneous with the application of forward force to footboard 118, the rider applies rearward force to handles 123 of oars 122 causing the blade end 125 of oars 122 to move to a forward position. From the forward position depicted in FIG. 3*a*, a rider simultaneously moves handles 123 of oars 122 forward while moving footboard 118 rearward. The rider's rearward force on footboard 118 causes set of second rails 114, outrigger 116, and pivot points 120 to move towards stern 108 of watercraft. Rearward movement of outrigger 116 and pivot points 120, combined with forward movement of handles 123 of oars 122, result in blade ends 125 of oars 122 moving rearward. FIG. 3*b* depicts the watercraft during the middle of a rider's stroke. With continued application of rearward force to footboard 118, and application of forward force to handles 123 of oars 122, footboard 118, set of second rails 114, outrigger 116, and pivot points 120 travel to a rearward position, as depicted in FIG. 3*c*. This represents the end of the rider's stroke and the sequence begins again by application of forward force to footboard 118 and moving footboard 118, set of second rails 114, outrigger 116, and pivot points 120 to a forward position, as depicted in FIG. 3*a*.

Figure 4:
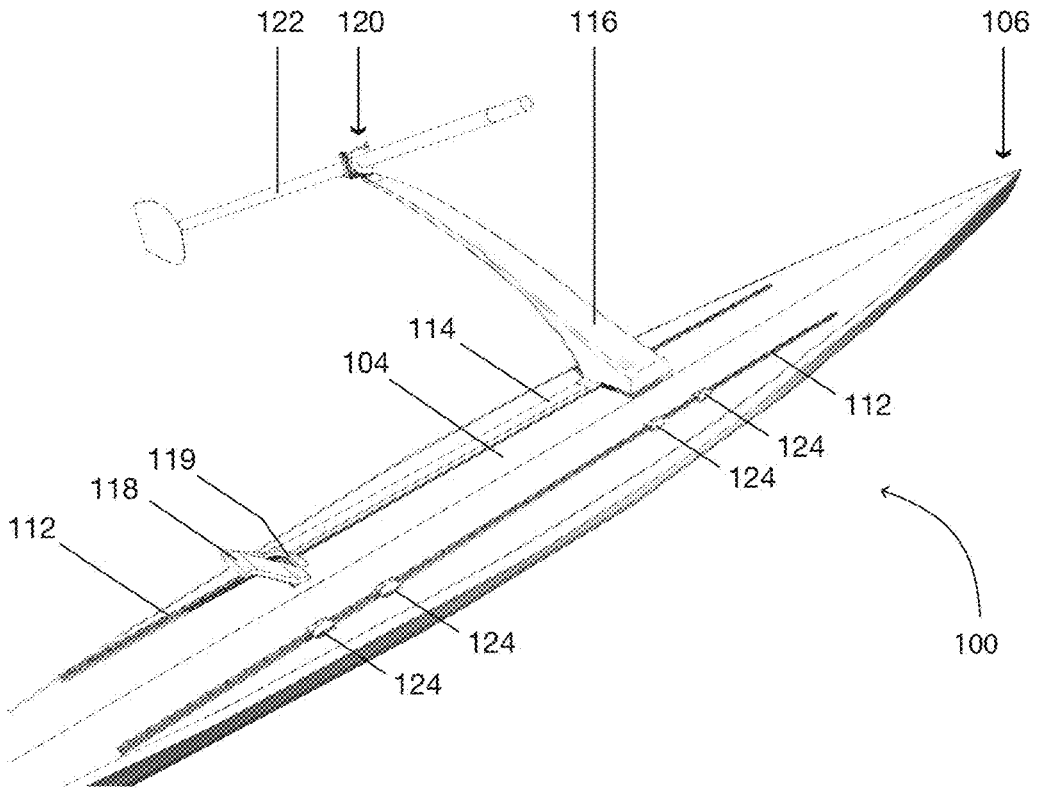
FIG. 4 shows a close-up, partial cutaway, isometric view of one embodiment of the novel watercraft assembly.

FIG. 4 shows a similar embodiment and view of watercraft 100 as FIG. 2 in partial cutaway to reveal bearing carriages 124 to contain bearings (not shown) to allow longitudinal movement as between first rail 112 and second rail 114. In a preferred embodiment, bearing carriages 124 are affixed to second rail 114. First rail 112 is adapted to receive bearing carriages 124 and allow longitudinal movement as between bearing carriages 124 and first rail 112. With bearing carriages 124 attached to second rail 114, longitudinal movement is allowed as between set of first rails 112 and set of second rails 114.

In an alternative embodiment, first rail 112 is adapted with a recess (not shown) sufficient to retain a plurality of bearings (not shown). Second rail 114 is adapted to contact bearings retained in first rail 112 so as to allow longitudinal movement as between first rail 112 and second rail 114. In an alternative embodiment, second rail 114 is adapted with recess (not shown) to retain a plurality of bearings (not shown) and first rail 112 is adapted to contact bearings retained in second rail 114 so as to allow longitudinal movement as between first rail 112 and second rail 114.

Figure 5:
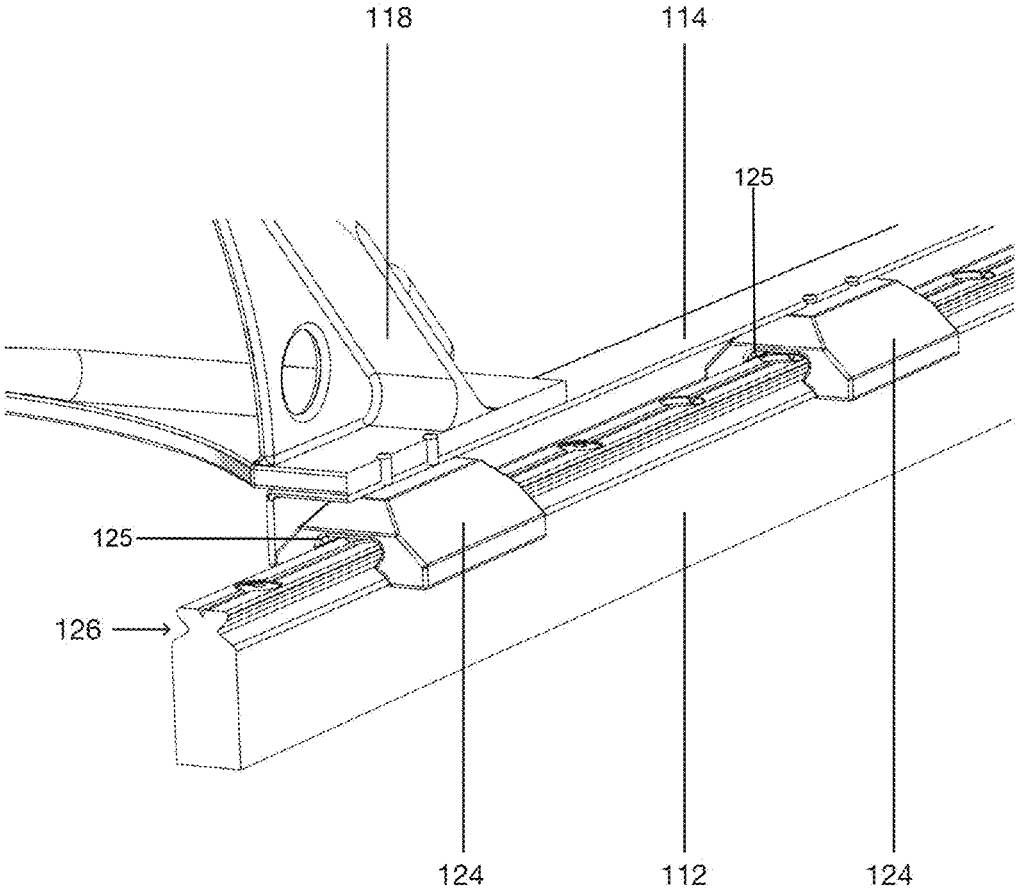
FIG. 5 shows a stern-to-bow, detailed view of one embodiment of the novel watercraft assembly depicting a slide assembly and footboard.

FIG. 5 provides a detailed view of one embodiment of watercraft 100. FIG. 5 includes a detailed view of set of first rails 112 and set of second rails 114 of slide assembly 110 (not fully depicted). In the depicted embodiment, set of first rails 112 are affixed to deck 104 (not depicted), and set of first rails 112 include longitudinal groove 126 for contacting bearings 125 contained in bearing carriages 124 that are affixed to set of second rails 114.

In some embodiments, bearings 125 may be of different types including, but limited to, rolling element bearings, linear bearings, fluid bearings, or magnetic bearings.

It is further contemplated that other methods of allowing movement as between first rail 112 and second rail 114 of slide assembly 110 are useful, including the use of lubricated rails.

It is further contemplated that bearings 125 contained in bearing carriages 124 may be composed of various materials including, but not limited to metal, steel, aluminum, carbon fiber, plastic, plastic composite, or other durable materials suitable to the chosen environment for use of watercraft 100.

In some embodiments, set of first rails 112 and set of second rails 114 of slide assembly 110 may each be composed of various materials including, but not limited to metal alloys, steel, aluminum, plastic, plastic composite, nylon, carbon fiber, fiberglass or other durable materials suitable to the chosen environment for use with watercraft 100. Similarly, in various embodiments described herein, hull 102, deck 104, and outrigger 116 may be composed of various materials including, but not limited to, wood, aluminum, plastic composite, plastic, carbon fiber, fiberglass or other durable materials suitable to the chosen environment for use in watercraft 100. In certain embodiments hull 102 and deck 104 constitute a singular unitary assembly. In various embodiments, hull 102 and deck 104 are a unitary assembly, including a surfboard, paddleboard, sculling boat, or other composite watercraft.

Figure 6:
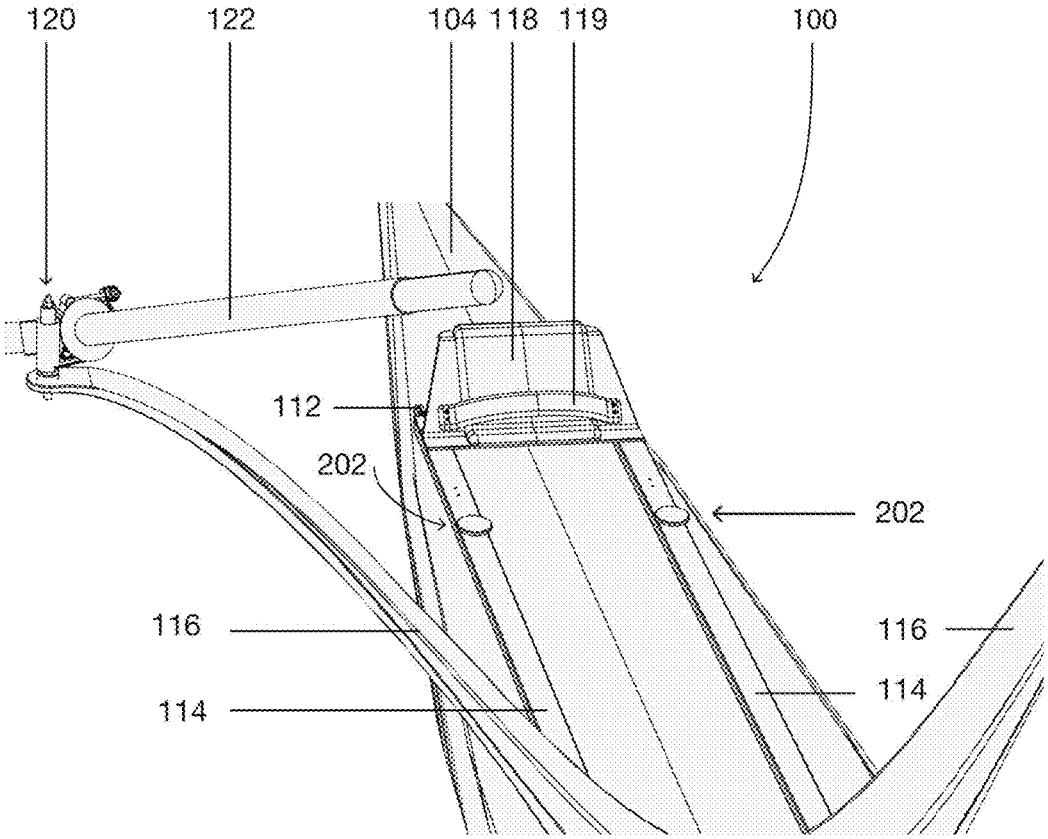
FIG. 6 shows a close-up view of one embodiment of the novel watercraft assembly depicting the foot-activated brake.

With reference to FIG. 6, one embodiment of watercraft 100 includes foot activated brake mechanism 200 attached to second rail 114. Pressure applied to contact surface 202 of brake mechanism 200 prevents movement of slide assembly 110 (not fully depicted) by restricting movement as between set of first rails 112 and set of second rails 114.

Figure 7A:
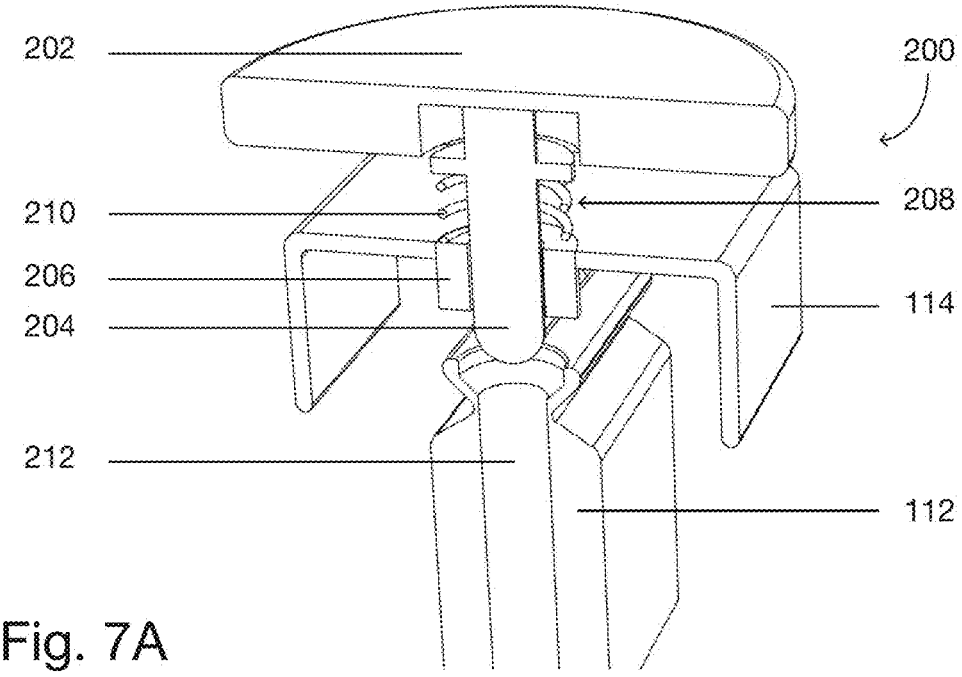
FIG. 7A shows a detailed view of a foot-activated brake in a disengaged position for use with one or more embodiments of the novel watercraft assembly.
Figure 7B:
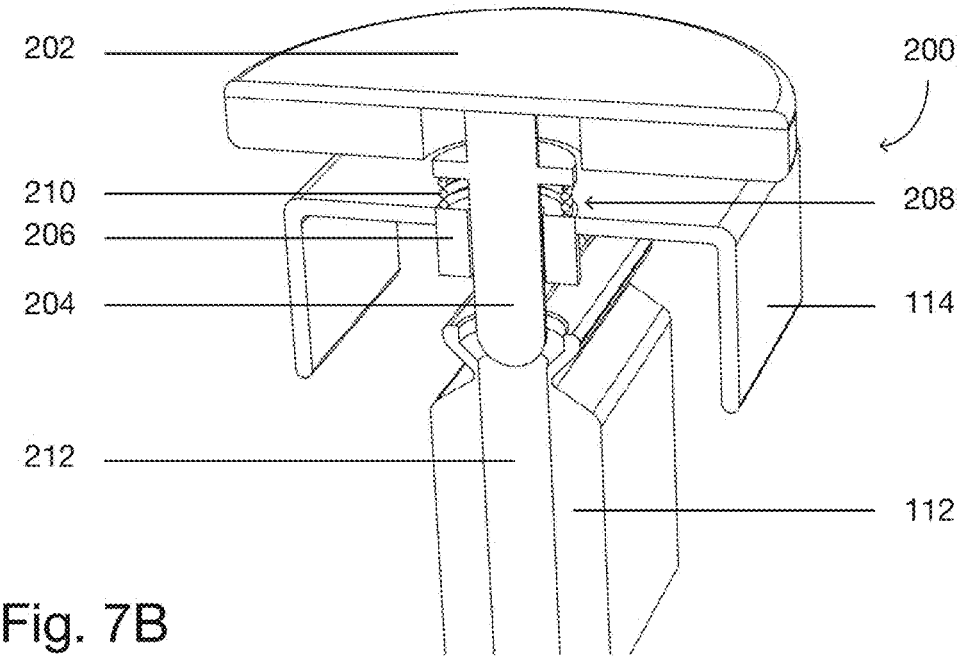
FIG. 7B shows a detailed view of the foot-activated brake in an engaged position for use with one or more embodiments of the novel watercraft assembly.

With reference to FIG. 7*a*, in one embodiment, brake mechanism 200 includes contact surface 202 for receiving pressure from a rider's foot. Post 204 is connected to contact surface 202, and inserted through collet 206 in recess 208 formed in second rail 114. Spring 210 surrounds post 204 and interacts with second rail 114 and post 204 to maintain post 204 in a disengaged position relative to first rail 112 and brake receiving hole 212. With reference to FIG. 7*b*, brake mechanism 200 is engaged by application of force to contact surface 202, compressing spring 210 and moving post 204 into brake receiving hole 212 formed in first rail 112. In alternative embodiments, spring 210 interacts with second rail 114 and contact surface 202.

In alternative embodiments of watercraft 100, brake mechanism 200 includes a friction surface (not depicted) attached to post 204. In such embodiments, the friction surface may each be composed of various materials including, but not limited to rubber, metal, plastic, a composite material, or other durable friction surfaces suitable to the chosen environment for use on watercraft 100. In such an embodiment, it is not necessary to adapt first rail 112 to interact with a friction surface (not depicted) attached to post 204. This embodiment does not require brake receiving recess 208. In this embodiment, brake mechanism 200 is engaged by application of force to contact surface 202, compressing spring 210 and forcing a friction surface (not depicted) attached to post 204 into contact with first rail 112. In some embodiments, contact surface 202 is attached to footboard 118.

In alternative embodiments, brake mechanism 200, including a friction surface attached to post 204, and spring 210, is attached to footboard 118. In one such embodiment, brake mechanism 200 is engaged by application of force to contact surface 202, compressing spring 210 and forcing a friction surface into contact with deck 104. In other embodiments, brake receiving hole 212 is formed in deck 104. Application of force to contact surface 202, engages brake mechanism 200 and moves post 204 into brake receiving hole 212 formed in deck 104.

In another alternative embodiment, brake mechanism 200 includes a caliper (not depicted) activated by application of force to contact surface 202. Friction pads (not depicted) installed on the caliper interact with first rail 112 to restrict movement as between first rail 112 and second rail 114. The friction pads may be composed of any suitable material based on the intended environment for watercraft 100 including, but not limited to, rubber, metal, plastic, a composite material, or other durable friction surfaces suitable to the chosen environment for use on watercraft 100.

While the invention has been described above with reference to various exemplary embodiments, many changes, combinations and modifications may be made to the exemplary embodiments without departing from the scope of the invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of this invention.

What is claimed is:

1. A watercraft for standup rowing, said watercraft comprising:

a hull having first and second opposed ends;

a deck affixed to said hull, said deck including a surface for supporting a rider;

a slide assembly affixed to said deck, said slide assembly having a first end and a second end, said slide assembly further including a first rail configured to receive a second rail, said first and second rails configured for longitudinal movement relative to each other;

an outrigger attached to said first end of said slide assembly, said outrigger comprising at least one pivot point extending outwardly from said deck, said pivot point adapted to accept an oar; and a footboard attached to said second end of said slide assembly, said footboard including a restraining strap.

2. The watercraft of claim 1 wherein said slide assembly further comprises a set of first rails and a set of second rails.

3. The watercraft of claim 1 wherein said slide assembly is configured to be removably attached to said deck.

4. The watercraft of claim 1 wherein said hull and deck comprise a composite assembly.

5. The watercraft of claim 1 further comprising a brake mechanism attached to said watercraft.

6. The watercraft of claim 5 wherein said brake mechanism is attached to said second rail of said slide assembly, further comprising a recess defined in said first rail of said slide assembly, and said brake mechanism further comprising:

a contact surface;

a boss having engaged and disengaged positions connected to said contact surface, said boss adapted to engage said recess in said first rail of said slide assembly when in said engaged position; and a spring to urge said boss in said disengaged position relative to said recess in said first rail of said slide assembly.

7. The watercraft of claim 6 further including a mechanism to maintain said boss in said engaged position relative to said recess in said first rail of said assembly.

8. The watercraft of claim 5 wherein said brake mechanism further comprises:

a contact surface;

a boss connected to said contact surface;

a friction surface connected to said boss and moveable by actuation of said contact surface, said friction surface having engaged and disengaged positions, said friction surface in said engaged position being adapted to contact said first rail of said slide assembly; and a spring to urge said friction surface in said disengaged position relative to said first rail of said slide assembly.

9. The watercraft of claim 8 wherein said braking mechanism further comprises a caliper to urge said friction surface in a disengaged position relative to said braking surface.

10. The watercraft of claim 5 wherein said brake mechanism is attached to said footboard of said slide assembly.

11. The watercraft of claim 10 said brake mechanism further comprising:

a contact surface;

a boss connected to said contact surface;

a friction surface connected to said boss and moveable by actuation of said contact surface, said friction surface having engaged and disengaged positions, said friction surface in said engaged position being adapted to contact said deck; and a spring to urge said friction surface in said disengaged position relative to said deck.

12. A paddle board configured for a person to stand thereon, comprising:

a paddle board, said paddle board including a surface for supporting a rider;

a slide assembly attached to said deck, said slide assembly having a first end and a second end, said slide assembly comprising a first rail and a second rail, said second rail being configured to receive said first rail so as to allow longitudinal movement as between said first rail and said second rail;

an outrigger attached to said first end of said slide assembly, said outrigger comprising at least one pivot point extending outwardly from said deck, said pivot point adapted to accept an oar; and a footboard attached to said second end of said slide assembly, said footboard including a restraining strap.

13. The paddle board of claim 12 wherein said slide assembly further comprises a set of first rails and a set of second rails.

14. The paddle board of claim 12 wherein said first rail of said slide assembly further includes a plurality of bearings retained in said first rail, and wherein said second rail is adapted to contact said plurality of bearings retained in said first rail.

15. The paddle board of claim 12 further comprising a plurality of bearings retained in at least two bearing carriages, said bearing carriages being attached to said second rail of said slide assembly, and further being adapted to receive said first rail of said slide assembly, said first rail of said slide assembly being adapted to contact said plurality of bearings so as to allow longitudinal movement of said bearing carriages and said first rail of said slide assembly.

16. The paddle board of claim 12 wherein said slide assembly is removably attached to said deck.

* * * * *